US005350013A

United States Patent [19]

Jani et al.

[11] Patent Number: 5,350,013

[45] Date of Patent: Sep. 27, 1994

[54] MANDREL OPERATED TORQUE ANCHOR

[75] Inventors: Bill Jani; Thomas Garay; John Ravensbergen, all of Calgary, Canada

[73] Assignee: Variperm (Canada) Limited, Alberta, Canada

[21] Appl. No.: 115,341

[22] Filed: Aug. 31, 1993

[51] Int. Cl.[5] ..... E21B 23/00

[52] U.S. Cl. ..... 166/217

[58] Field of Search ..... 166/118, 134, 206, 212, 166/216, 217

[56] References Cited

U.S. PATENT DOCUMENTS

| | | | |
|---|---|---|---|
| 4,047,565 | 9/1977 | Crickmer | 166/217 |
| 4,049,055 | 9/1977 | Brown | 166/217 X |
| 4,059,150 | 11/1977 | Manderscheid | 166/217 X |
| 4,359,090 | 11/1982 | Luke | 166/217 |

FOREIGN PATENT DOCUMENTS

| | | |
|---|---|---|
| 633778 | 1/1962 | Canada . |
| 653892 | 12/1962 | Canada . |
| 704201 | 2/1965 | Canada . |
| 973473 | 8/1975 | Canada . |
| 1255584 | 6/1989 | Canada . |
| 1274470 | 9/1990 | Canada . |
| 1281998 | 10/1991 | Canada . |

*Primary Examiner*—Michael Powell

*Attorney, Agent, or Firm*—Kane, Dalsimer, Sullivan, Kurucz, Levy, Eisele & Richard

[57] ABSTRACT

A mandrel-operated tension torque anchor for insertion into the casing of a well to anchor the pipe string from rotation and vertical movement. The anchor comprises drive member for cones to operate anchoring slips, which drive member are operatively secured to the mandrel to rotate therewith and threadably secured to the anchor frame so as to cause movement of the cones into anchoring position on rotation of the mandrel in one direction.

13 Claims, 4 Drawing Sheets

MANDREL OPERATED TORQUE ANCHOR

The present invention relates to a mandrel-operated tension torque anchor for insertion into the casing of a well for operation in conjunction with either a tension or torque-type pump.

BACKGROUND OF THE INVENTION

Conventional anchors used in oil wells for supporting pumps or the like within the well casing incorporate a tubular anchor frame, a drag block for bearing against the walls of the casing to prevent rotative movement of the anchor frame while the anchor is being set and a plurality of slips having upper and lower feet mounted within a slip cage secured to the frame, each of the slips actuable by pairs of cones mounted on the frame to slide towards each other into anchoring position under the slip feet and force the slips outwardly into anchor supporting engagement with the walls of the casing.

Regular or conventional anchors are generally not suitable for wells that require a torque pump. Torque pumps will apply pressure directly to shear release screws of the anchors, through the slips, which torque could release the anchor prematurely.

Canadian Patent No. 1,274,470 of Weber issued Sep. 25, 1990 teaches an anchor which has a shear release mechanism and rotationally induced slip movement through use of a mandrel. The slips are driven into anchor supporting engagement by means of cams mounted on the mandrel surface.

Canadian Patent No. 973,473 of Young issued Aug. 26, 1975 describes and illustrates a slip design for an anchor which requires expanders similar to cones. This tool both sets and releases under tension.

Canadian Patent No. 704,201 of Conrad issued Feb. 23. 1965 teaches an anchor device which has a torque-operated setting mechanism and a tension operated secondary release mechanism.

Other patents of general background interest include Canadian Patent No. 653,892 of Clark et al issued Dec. 11, 1962, Canadian Patent No. 633,778 of Conrad issued Jan. 2, 1962, Canadian Patent No. 1,281,998 of Braddick issued Oct. 6, 1991 and Canadian Patent No. 1,255,584 of Scranton et al issued Jun. 13, 1989.

It is an object of the present invention to provide an anchor which operates in conjunction with either a tension or a torque-type pump in a well. It is a further object of the present invention to provide such an anchor which prevents the pipe string and stator from rotating or from moving up or down when the anchor is set in a well casing.

SUMMARY OF THE INVENTION

In accordance with the present invention, there is provided a mandrel-operated tension torque anchor for insertion into the casing of a well to anchor the pipe string from rotation and vertical movement. The anchor is of the type comprising a tubular anchor frame including a drag block means and a plurality of slips having upper and lower feet mounted within a slip cage secured to the frame. Each of the slips is actuable by pairs of cones associated with the frame to slide towards each other into anchoring position under the feet of the slips and force them outwardly into anchoring position engaging walls of the casing so as to prevent rotary and vertical movement of the anchor frame in the casing. Actuation means cause the cones and slips to move relatively together into that anchoring position. In addition, the anchor is provided with an emergency release assembly for disassociating the anchor from the casing on tension being applied to the mandrel. In the improvement according to the present invention, the actuation means comprise drive means operatively secured to the mandrel so as to rotate therewith and isolate the emergency release assembly from the setting force applied to the slips. The drive means is threadably secured to the frame so as to cause movement of the cones into anchoring position upon rotation of the mandrel in one direction.

In one preferred embodiment according to the present invention, the drive means comprise pairs of keys movable longitudinally relative to the mandrel and the frame. One side of each key threadably engages corresponding threads on the frame. The other side has a projection which extends into a longitudinally extending groove associated with the mandrel to prevent relative rotation of the key with respect to the mandrel. Rotating the mandrel in the one direction causes the keys of each pair to move longitudinally towards each other, forcing corresponding pairs of cones to slide towards each other into anchoring position with respect to the slip feet.

In another preferred embodiment according to the present invention, the drive means has on an outer surface threads which engage threads on the frame. These threads cause the frame to move, longitudinally with respect to the mandrel upon rotation of the mandrel, the slips and cones into anchoring position. The actuation means is preferably a sleeve secured by securing means to the mandrel. As well, said one cone of each of the pairs of cones is preferably associated with the frame so as to be moved longitudinally with it. The other of the cones is provided with means to disassociate it from the frame so as not to move longitudinally with it. The slips and anchor frame are constructed so that longitudinal movement of said one cones and frame, upon rotation of the mandrel in one direction, will move said one cones and slips into anchoring position with respect to each other and said other cones of each of the pairs of cones.

The anchor according to the present invention prevents the pipe string from rotating while, at the same time, preventing that pipe from moving up or down during operation of the pump in the well. The anchor is simple to operate and set, by simply turning the mandrel e.g. two turns to the right to cause a setting force between opposing thread components, which force is then transferred to the cones and onto the slips. The invention permits release of the anchor either through the retraction of the slips by a reverse turning of the mandrel or, alternatively, by shear means as will be described in more detail hereinafter.

The anchor according to the present invention is suitable for torque pumps which, if used with conventional anchors, would apply pressure directly to shear release screws through the slips to release the anchor prematurely. The anchor according to the present invention controls the pressure generated through the slips and permits shear release screws to operate properly in tension only. This prevents movement of the pipe string during the tension or torque-type pump operation, thus increasing the pump efficiency.

It is an object of the present invention to provide a novel construction of mandrel-operated tension torque anchor for insertion into the casing of a well for operation in conjunction with either a tension or torque-type pump.

It is a further object of the present invention to provide an anchor to prevent the rotation of a pipe string while, at the same time, preventing the pipe string from vertical movement during pump operation.

BRIEF DESCRIPTION OF THE DRAWINGS

These and other objects and advantages of the invention will become apparent upon reading the following detailed description and upon referring to the drawings in which.

Figure 1:
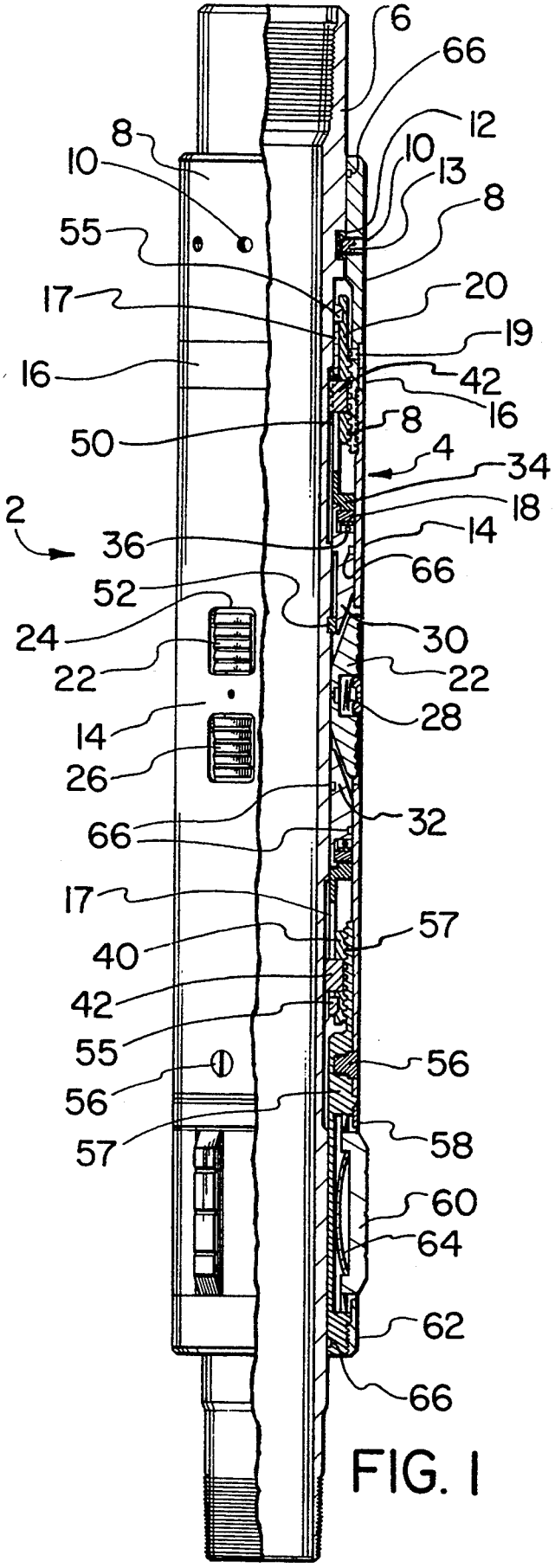
FIG. 1 is a front elevation, in partial section, of an anchor according to the present invention intended for smaller diameter pipes in running unset position.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to FIG. 1 there is illustrated an example embodiment of anchor (2) in accordance with the present invention. Anchor (2) includes a tubular main frame (4) having a central passage therethrough and having within it a mandrel (6). A relatively broad retainer ring (8), is circumferentially disposed at the upper portion of the frame (4) and possesses a plurality of apertures (10), containing shear sleeve (12) and shear screws (13). The retainer ring (8) is disposed vertically above, and connected to, the slip cage (14) with pin retainer ring (16) serving as a spacer ring. The pin retainer ring (16) contains stop pins (19) which in conjunction with the upper sub (20) maintain the slips (22) in a contracted position while running the anchor (2) into a well or removing it therefrom. The slip cage (14) is securably mounted to frame (4). Within the slip cage (14) are a plurality of rectangular pairs of apertures (24), longitudinally spaced and circumferentially disposed about the central portion of the anchor. As further illustrated in FIG. 1, housed within the apertures are a plurality of casing gripping members in the form of slips (22), circumferentially spaced to correspond with apertures (24). The slips (22) possess two substantially rectangular feet having outer surfaces bearing a plurality of wickers (26). The wickers (26) of the slip feet in the upper position are oriented in a downward direction and the slip feet in the lower position are oppositely oriented so that, when engaged with the well casing, the slips will resist movement of the anchor and tubing in both vertical directions, as well as in a rotational direction.

Within the recessed central portion of the slips (22) are housed slip springs (28) which, upon their contraction, transmit a force to the slips contributing to the maintenance of the retracted position of the slips when the anchor is run into or removed from a well.

Figure 2:
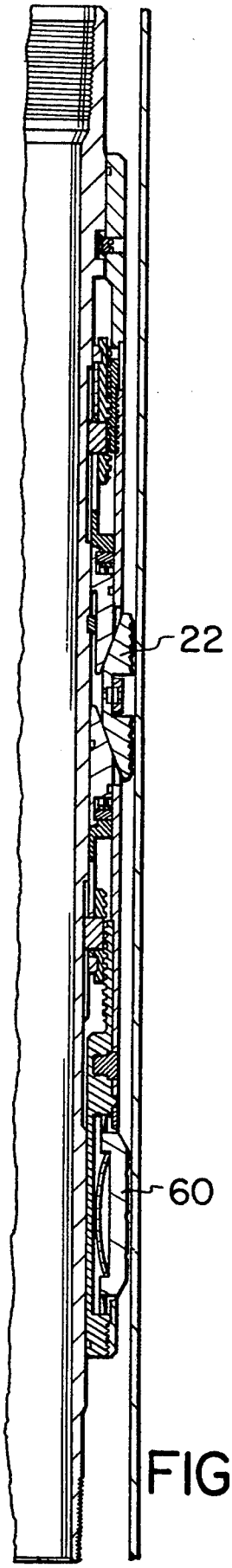
FIG. 2 is a partial front elevation, in section, of the anchor of FIG. 1 in set position.
Figure 3:
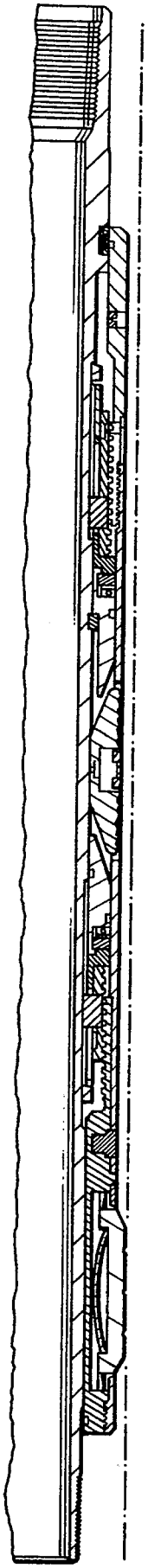
FIG. 3 is a partial front elevation, in section, of the anchor of FIG. 1 in sheared position.

As further illustrated in FIG. 1, the inwardly facing surface of the slips (22) are tapered at the top and bottom and these inclined surfaces engage corresponding surfaces on cones (30) and (32). The cones (30) and (32), disposed vertically above and below the slips (22) in running position, are constructed so as to move longitudinally in opposite directions, under urging from drive means which will be described in more detail hereinafter, towards the slips (22). Continued movement of the cones (30) and (32) after initial engagement with corresponding slip surfaces transmits a force to the slip surfaces capable of urging the slips outwardly through their corresponding apertures and causing them to engage with the well casing (FIG. 2). The apertures are of sufficient area to allow the rectangular feet of the slips (22) to pass therethrough.

As should be evident from the drawings, the position of upper and lower cones (30) and (32) is substantially similar and symmetrical about the approximate center of the anchor. Positioned above the upper cone (30) are a cone sub (34), stop pins (18), and bearing (36). This assembly is capable of longitudinal movement and directly transmits a force to the corresponding upper cone sufficient to cause their displacement. A similar arrangement is found below each lower cone (32).

The drive means responsible for the movement of the cone sub assemblies and cones (30) and (32), consists of upper and lower drive subs (20) and (40), keys (42), and threaded components (8) and (57) mounted to tile anchor frame (4). Rotational motion of the mandrel (6) is responsible for the relative longitudinal motion of the drive means. The keys (42), connected to longitudinal grooves (50) in the mandrel (6), prevent relative rotation of the upper and lower drive subs (20) and (40) with respect to the mandrel (6).

The upper and lower drive subs (20) and (40) are threadably engaged respectively with the components (8) and (57) mounted to the anchor frame (4) and may move longitudinally upon rotation of the mandrel (6). A spacer sleeve (17) is disposed on the mandrel (6) at each drive assembly and moves longitudinally with respect to the mandrel (6) allowing for relative displacement of stop segment (55) along its length to facilitate release of slips (22) under tension when secondary shear release operation is required. When in anchored position, the drive subs (20) and (40) are displaced with respect to the anchor frame (4), the system being locked together by means of segments (55) and keys (42) which are connected to mandrel (6) and place a force on the cone subs (34). This configuration extends torque from the mandrel onto the drive means causing a setting force between the opposing threaded components (8) and (57). The slip cage (14) operates to transfer this setting force from one drive means to the other.

As further illustrated in FIG. 1, within the frame are disposed a plurality of connecting screws (56) toward the lower section of the frame (4). Forming part of the anchor's frame, and being disposed vertically below the connecting screws, are a conventional drag retainer (58), drag blocks (60), and retainer ring (62) forming a drag means.

A plurality of drag blocks (60), are urged outwardly by drag block springs (64). The drag blocks (60) extend outwardly beyond the frame and are longitudinally oriented. By means of the drag block springs (64), the drag blocks (60) are capable of extending and contracting with respect to the anchor frame (4). The force generated by the drag block springs (64) is capable of creating a force between the well casing and the drag blocks (60) sufficient to prevent rotation of the anchor during engagement of the slips (22).

The extreme lower portion of the mandrel (6) is slightly tapered and threaded around its lower periphery to receive other components such as, for example, a pump.

O-rings (66) seal all working, releasing, and setting parts of the anchor.

The shear sleeve (12) and shear screws (13) in the upper retainer ring (8), when placed under longitudinal tension, shear to release the mandrel (6). Shear sleeve (12) extends between the anchor frame (4) and the mandrel (6) permitting relative rotation of the mandrel (6) with respect to the anchor frame (4) while preventing relative longitudinal movement therebetween. Also forming a part of this secondary release assembly are segments (52) and (55). Segment (55) is positioned approximately at the upper end of spacer sleeve (17). It is capable of being associated with a corresponding groove in the mandrel (6) to allow the cones to longitudinally move away from the slips (22) during release of the anchor. Segment (52) is attached to the mandrel (6) and disposed behind the inclined back surface of the slips (22). When the upper cone (30) is in a suitably raised position, segment (52) will become associated with the inner step of the tipper cone (30) upon vertical lift of the mandrel (6) to facilitate removal of the entire anchor.

In operation, a pipe string is connected to the mandrel (6) of the anchor and lowered into the well inside the anchor's frame (4). When running into a well, the slips (22) and the slip springs (28) remain contracted by means of the operation of stop pin (19) and cap screws (56) which maintain the position of upper cone (30). The stop pin (19) is contained in spacer ring (16). The tipper retainer ring (8) is directly threaded to slip cage (14). Also forming part of the assembly, are the drag retainer (58), the drag body (57), the drag block (60), the drag block springs (64), and the retainer ring (62). The drag block springs (64) both force the drag block (60) to the casing wall and allow for contraction of the drag block (60) within the anchor frame (4). The force between the well casing and the drag block (60) caused by the drag block springs (64) allow the anchor to retain its position and not rotate when torque is applied.

Reaching setting depth, the mandrel (6) is rotated to the right at the surface through the tubing. The keys (42) prevent relative rotation of the keys with respect to the mandrel (6) and threadably engage corresponding threads on the frame (4). This process isolates the setting force caused by the rotation of the mandrel (6) by extending this torque onto the drive thread causing a setting force between the opposing threaded components (44) and (46). The shear sleeve (12) ensures that any torque stresses will further be isolated from the shear screws (13). The slip cage (14) serves to transfer the setting force from one drive train to the other. The upper and lower drive subs (20) and (40) are displaced in longitudinally opposite directions to converge on the cones (30) and (32). This longitudinal displacement pushes the cone sub (34), stop pin (18), and bearing (36), causing the tapered surfaces of the upper and lower cones (30) and (32) to push the corresponding surfaces on the slips (22), urging the slips (22) outwardly and causing the oppositely oriented wickers (26) of the slip's feet to engage with the well casing and prevent upward, downward, or sideward movement. With the slips' feet engaged with the well casing, the system is locked together by means of the keys (42) which are connected to the mandrel (6) with segment (55) which push the cone subs (34) to lock the system together.

Normal release of the anchor (2) is facilitated by rotating the tubing to the left which will execute in reverse order the normal setting procedure. In addition, however, an emergency shear release mechanism exists should the anchor (2) not release in a normal fashion. This emergency shear release mechanism is operated by tension, and requires an upward pull of the tubing of the anchors weight plus the total value of the shear screws (13). The operation of the emergency shear release system is as follows: the shear screws (13) will shear to release the mandrel (6). Under continued tension, the mandrel (6) can be moved vertically upwards to allow segments (55) to be positioned into one of two grooves in the mandrel (6). This allows both cones (30) and (32) and assembly to be free to move longitudinally away from the slips. This movement removes the support beneath the slips (22) which under operation of the slip springs (28) contract to a position within the anchor frame (4) disengaging the slip feet from the well casing. Continued upward movement of the mandrel (6), will cause the stop segments (52) to associate and move upwards simultaneously with the upper cone (30) which itself is connected to the mandrel (6) thus facilitating removal of the complete anchor. It is these locking segments (52) and (55), which ensure the full release of the anchor in an emergency release situation.

Figure 4:
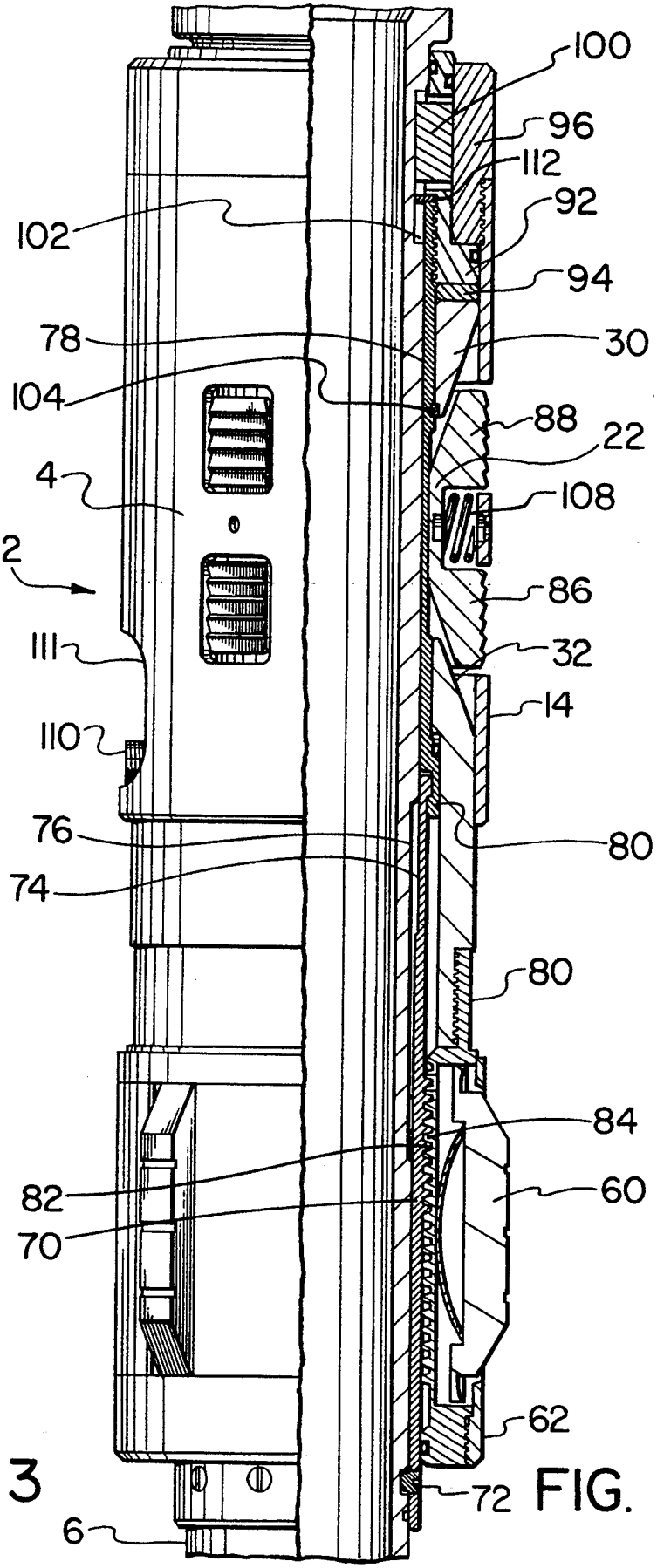
FIG. 4 is a front elevation, in partial section, of an alternative embodiment of anchor according to the present invention, intended for larger diameter pipes and illustrated in running, unset position.
Figure 5:
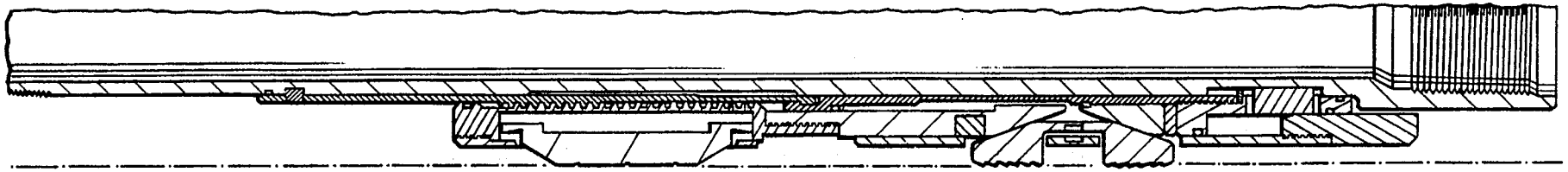
FIG. 5 is a partial front elevation, in section, of the anchor of FIG. 4 in set position.
Figure 6:
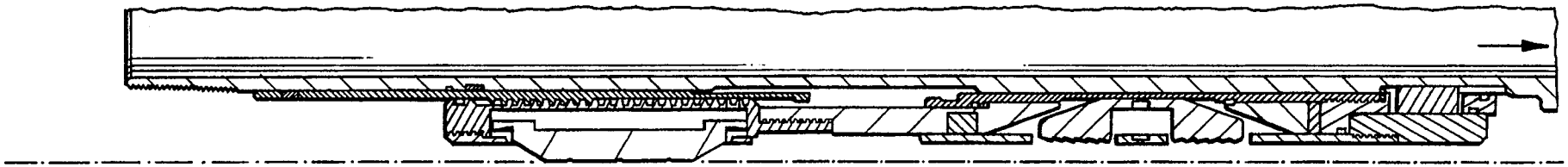
FIG. 6 is a partial front elevation, in section, of the anchor of FIG. 5 in sheared position.

In the alternative embodiment illustrated in FIGS. 4, 5 and 6, anchor frame (4) including drag block (60) and slip cage (14), is itself capable of movement relative to one of the cones of each pair, thus requiring relative longitudinal displacement driven by only one drive thread and one cone (32) to cause cones (30) and (32) to engage the slips (22) with the well casing.

Figure 7:
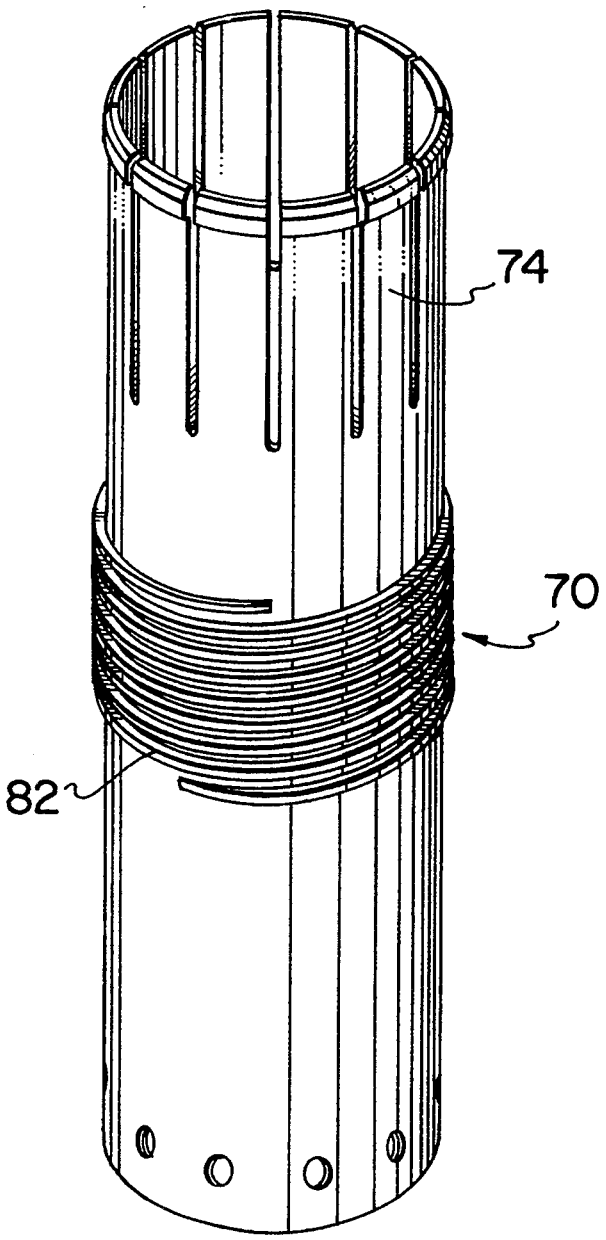
FIG. 7 is a perspective view of the lower sleeve of the anchor of FIGS. 4 to 6.

Such tool incorporates a lower sleeve (70), secured by shear screws (72) to a lower portion of mandrel (6). The upper end of sleeve (70) is provided with collet fingers (74) (FIG. 7) which are normally seated on a surface of mandrel (6) near their upper ends, just above a depression (76) formed in mandrel (6), the purpose of which will be described in more detail subsequently. An upper sleeve (78) is also seated on mandrel 16), fitted to and overlapping lower sleeve (70) at this tipper sleeve's lower end (80), normally to rotate with mandrel (6) and lower sleeve (70). Threads (82) on the outer surface of lower sleeve (70) engage corresponding threads on the inside surface of drag body (80), the threads oriented so that rotation of mandrel (6) in one direction (e.g. to the right) will cause drag body (80) to move, relative to sleeve (70) and mandrel (6), longitudinally upwards. Lower cones (32) being secured directly to the upper portions of drag body (80), are thereby moved upwardly to contact and bear against the rear surface of corresponding lower slip feet (86) of slip (22). Continued upward longitudinal movement of lower cones (32) forces slips (22) outwardly and moves slip cage (14) and slips (22) upwardly until the rear surface of upper slip feet (88) come into engagement with upper cones (30).

Each upper cone (30) is prevented from longitudinal movement, during rotation of mandrel (6). It is maintained in that position by retainer ring (92) which is secured to the upper end of upper sleeve (78) as illustrated. A bearing ring (94) separates the upper part of cone (30) from the lower part of retainer ring (92). A slip cage retainer ring (96) supports the slip cage, resting on a shoulder of retainer ring (92) as illustrated, slip cage retainer ring (96) not rotating with retainer ring (92) on mandrel (6) and upper sleeve (78), but "floating" with respect thereto.

When an opposite rotation of mandrel (6) is not sufficient to withdraw slips (22) from anchoring position, and it is desired to remove anchor (2) by upward, shearing force, the shear release of this embodiment of anchor is accomplished as follows. Upward force on mandrel (6) will cause shear screws (72) to shear, freeing lower sleeve (70) from its engagement with mandrel (6) and enabling mandrel (6) to be pulled upwardly. A slight upward relative movement of mandrel (6) with respect to anchor (2), and particularly lower sleeve (70) will result in the ends of collet fingers (74) slipping inwardly, into groove (76), thereby disassociating upper sleeve (78) from its seated engagement on lower sleeve (70). Upward relative movement of upper sleeve (78) with respect to lower sleeve (70) is achieved by mandrel (6) shouldering on stop ring (112) at mandrel shoulder (102), thereby transmitting force into retainer ring (92) and slip cage retainer ring (96). A snap ring (104), between the lower end of cone (30) and a portion of upper sleeve (78), as illustrated, pulls upper cone (30) up, as upper sleeve (78) is detached from lower sleeve (70) and thereby freed to move upwardly. This upward movement of sleeve (78) and upper cone (30) continues until upward force is exerted on slip cage (14) and on slips (22) to force them upwardly and drive the lower slip foot (86) off of lower cone (32). This now frees slips (22) to retract, away from anchoring position, under urging of spring (108). Finally, with continued upward movement of mandrel (6), set screws (110) which are seated in lower cone (32), at spaced locations about the anchor assembly, and the heads of which are seated in corresponding, longitudinally extending grooves (111 ) on the wall of slip cage (14), come to the bottom of that groove (111). Then lower cone (32) together with associated drag body (80) and lower sleeve (70) is dragged upwardly, to enable the entire anchor to be withdrawn together with mandrel (6).

Thus, the emergency release mechanism for anchor removal in the event of failure of normal release (by rotating mandrel (6) to the left, causing a reversal of the setting process for the anchor as previously described) is thus accomplished by the application of upwardly instituted tension on the mandrel (6) causing a shearing of screws (72) and the sequence of events as just described.

Thus it is apparent that there has been provided in accordance with the invention an anchor that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. In a mandrel-operated tension torque anchor for insertion into the casing of a well to anchor the pipe string from rotation and vertical movement, the anchor comprising a tubular anchor frame including a drag block means, a plurality of slips having upper and lower feet mounted within a slip cage secured to the frame, each of said slips actuable by pairs of cones associated with the frame and movable longitudinally relative thereto into anchoring position under the feet of the slips to force the feet outwardly into anchoring position engaging walls of the casing, so as to prevent rotary and vertical movement of the anchor frame in the casing, actuation means to cause the cones and slips to move relatively together into that anchoring position, and an emergency release assembly for disassociating the anchor from the casing on tension being applied to the mandrel; the improvement characterized in that the actuation means comprises drive means operatively secured to the mandrel so as to rotate therewith and isolate the emergency release assembly from the setting force applied to the slips, the drive means threadably secured to the frame so as to cause movement of the cones into anchoring position upon rotation of the mandrel in one direction.

2. An anchor according to claim 1 wherein said drive means comprise pairs of keys, movable longitudinally relative to the mandrel and the frame, one side of each key threadably engaging corresponding threads on the frame and the other side having a projection which extends into a longitudinally extending groove associated with the mandrel to prevent relative rotative movement of the key with respect to the mandrel, rotation of the mandrel in said one direction causing the keys of each pair to move longitudinally towards each other to force corresponding pairs of cones to slide towards each other into anchoring position with respect to the slip feet.

3. An anchor according to claim 2 wherein keys to operate the upper and lower feet are threadably engaged to the slip cage so that rotation of the mandrel in one direction will cause the keys to move the cones and slips into anchoring position.

4. An anchor according to claim 1 further provided with shear release means, operable on an upward pull on the mandrel and permit vertical withdrawal of the anchor from the casing.

5. An anchor according to claim 3 further provided with shear release means, operable on an upward pull on the mandrel and permit vertical withdrawal of the anchor from the casing.

6. An anchor according to claim 5 wherein the shear release means comprises a shear sleeve extending between the anchor frame and a corresponding portion of the mandrel to permit relative rotation of the mandrel with respect to the anchor frame while preventing relative longitudinal movement therebetween.

7. An anchor according to claim 1 wherein the drive means has on an outer surface threads which engage threads on the frame to move the frame longitudinally with respect to the mandrel upon rotation of the mandrel, the frame and corresponding slips and cones associated with each other so that, upon rotation of the mandrel, the slips and cones are moved relative to each other into anchoring position.

8. An anchor according to claim 7 wherein the actuation means is a sleeve secured by securing means to the mandrel.

9. An anchor according to claim 8 wherein one cone of each of the pairs of cones is associated with the frame so as to be moved longitudinally with it and the other of the cones is provided with means to disassociate it from the frame so as not to move longitudinally with it, the slips and anchor frame constructed so that longitudinal movement of said one cones and frame, upon rotation of the mandrel in one direction will move said one cones and slips into anchoring position with respect to each other and said other cones of each of the pairs of cones.

10. An anchor according to claim 8 wherein the securing means comprise a plurality of shear pins constructed to separate the sleeve from the mandrel upon application of sufficient longitudinal force to the mandrel.

11. An anchor according to claim 8 wherein floating means are associated with said other cones wherein each of said other cones is maintained at the same relative longitudinal position with respect to the mandrel while said corresponding cone is moved into anchoring position with respect to its corresponding slip.

12. An anchor according to claim 11 wherein said floating means comprises a retainer ring.

13. An anchor according to claim 1 wherein the upper and lower feet of the slips are provided with oppositely oriented wickers to prevent movement in the vertical direction when in anchoring position within a casing.

* * * * *